US009229394B2

(12) United States Patent
Hazeyama et al.

(10) Patent No.: US 9,229,394 B2
(45) Date of Patent: Jan. 5, 2016

(54) FIXING DEVICE

(71) Applicant: Brother Kogyo Kabushiki Kaisha, Nagoya-shi, Aichi-ken (JP)

(72) Inventors: Tomoaki Hazeyama, Yokkaichi (JP); Naoyuki Iwata, Kagamihara (JP); Yasuhiro Maruyama, Kasugai (JP); Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,521

(22) Filed: Mar. 27, 2015

(65) Prior Publication Data

US 2015/0277314 A1 Oct. 1, 2015

(30) Foreign Application Priority Data

Mar. 31, 2014 (JP) ..... 2014-074879

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2028; G03G 15/2053; G03G 2215/2035
See application file for complete search history.

(56) References Cited

U.S. PATENT DOCUMENTS

| | | | | |
|---|---|---|---|---|
| 5,742,878 | A | 4/1998 | Kuroda | |
| 7,269,365 | B2 * | 9/2007 | Mochizuki et al. | 399/33 |
| 8,934,804 | B2 * | 1/2015 | Suzuki et al. | 399/90 |
| 9,002,249 | B2 * | 4/2015 | Uekawa et al. | 399/329 |

FOREIGN PATENT DOCUMENTS

JP H06-003982 A 1/1994

* cited by examiner

*Primary Examiner* — Gregory H Curran
(74) *Attorney, Agent, or Firm* — Banner & Witcoff, Ltd.

(57) ABSTRACT

A fixing device includes an endless belt, a nip member having a contact surface that is in contact with the inner surface of the endless belt, a backup member configured to pinch the endless belt in conjunction with the nip member, an upstream guide disposed upstream of the nip portion in the rotating direction, and a regulating portion. The upstream guide and the nip member are disposed while a first gap is provided, in a conveying direction of the recording sheet, between a middle portion of the upstream guide and a middle portion of the nip member. The regulating portion and one of the upstream guide and the nip member are disposed while a second gap is provided therebetween in the conveying direction of the recording sheet. The second gap is smaller than the first gap in the conveying direction of the recording sheet.

8 Claims, 8 Drawing Sheets

FIXING DEVICE

CROSS-REFERENCE TO RELATED APPLICATION

This application claims priority from Japanese Patent Application No. 2014-074879, filed on Mar. 31, 2014, which is incorporated herein by reference in their entirety.

TECHNICAL FIELD

Aspects described herein relate to a fixing device for fixing a developing agent image onto a recording sheet by heat.

BACKGROUND

A known fixing device includes an endless belt, a nip member, a backup member, and an upstream guide. The nip member is disposed inside a loop of the endless belt. The backup member pinches the endless belt in conjunction with the nip member to form a nip portion between the endless belt and the backup member. The upstream guide is disposed upstream of the nip portion in a rotating direction of the endless belt. The upstream guide guides rotation of the endless belt toward the nip portion. In the fixing device, more specifically, a downstream end portion of a guide surface of the upstream guide and an upstream end portion of the nip member are spaced apart from each other in a sheet conveying direction by a gap. More specifically, the gap between the downstream end portion of the guide surface of the upstream guide and the upstream end portion of the nip member in the sheet conveying direction has a constant width in a width direction of the endless belt.

SUMMARY

The endless belt may have a particular portion to which a pressing force is not applied by the backup member. In the known fixing device, the gap having the constant width provided in the conveying direction between the downstream end portion of the guide surface of the upstream guide and the upstream end portion of the nip member may allow edge portions of the particular portion of the endless belt to move freely, thereby causing the edge portions of the particular portion of the endless belt to be caught in the gap therebetween. Therefore, the edge portions of the endless belt may remain bending.

Accordingly, some embodiments of the disclosure provide for a fixing device in which edge portions of an endless belt may be avoided from being caught in a gap between the upstream guide and the nip member.

According to one or more aspects of the disclosure, a fixing device includes an endless belt, a nip member having a contact surface that is in contact with the inner surface of the endless belt, a backup member configured to pinch the endless belt in conjunction with the nip member, an upstream guide disposed upstream of the nip portion in the rotating direction, and a regulating portion. The upstream guide and the nip member are disposed while a first gap is provided, in a conveying direction of the recording sheet, between a middle portion of the upstream guide and a middle portion of the nip member. The regulating portion and one of the upstream guide and the nip member are disposed while a second gap is provided therebetween in the conveying direction of the recording sheet. The second gap is smaller than the first gap in the conveying direction of the recording sheet.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings. With reference to a color laser printer 1, directions of up, down, right, left, front, and rear may be defined with reference to an orientation of the color laser printer 1 that is disposed in which it is intended to be used as depicted in FIG. 1.

Figure 1:
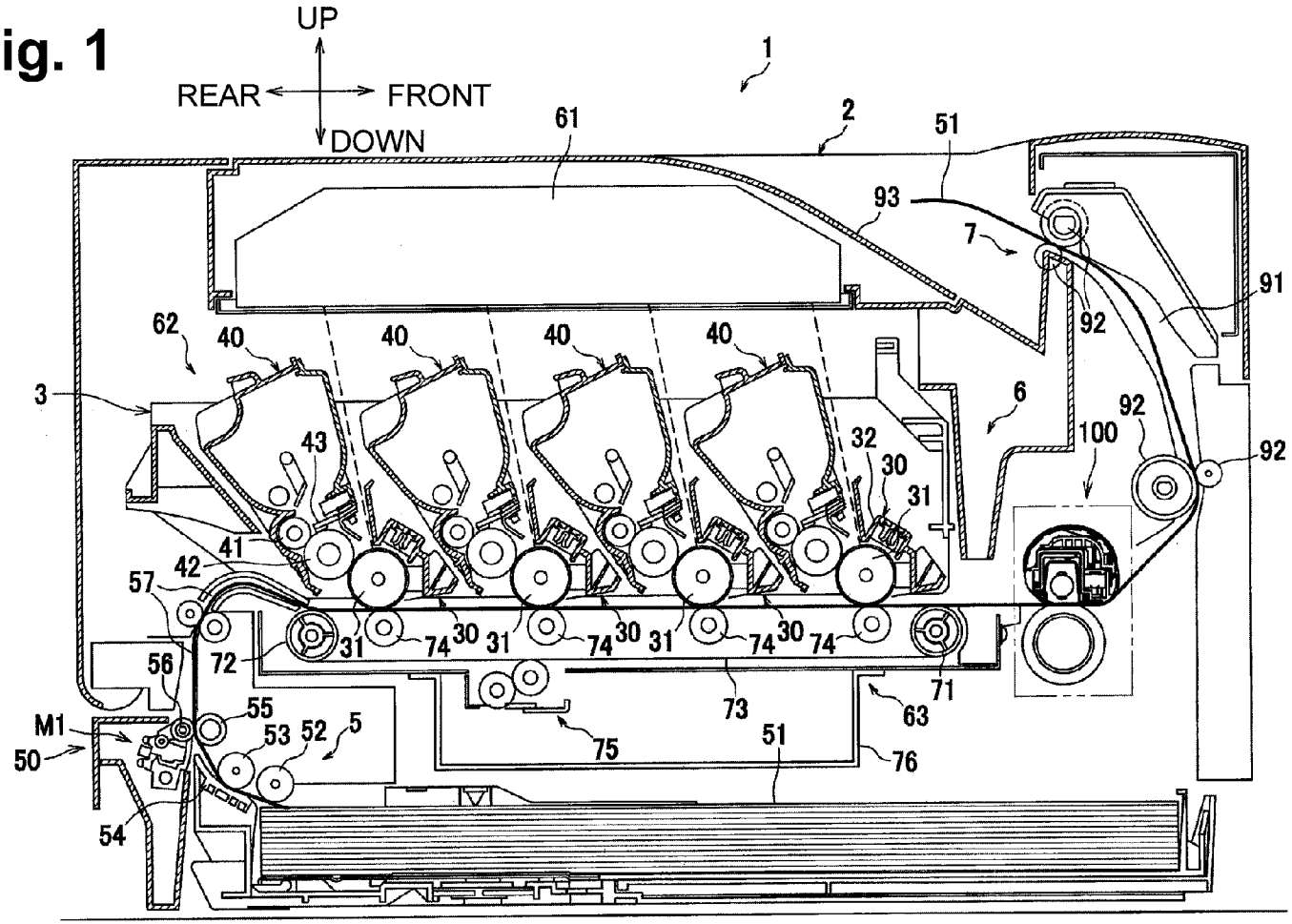
FIG. 1 is a sectional view depicting a color laser printer including a fixing device in an illustrative embodiment according to one or more aspects of the disclosure.

As depicted in FIG. 1, the color laser printer 1 includes a feed unit 5, an image forming unit 6, and a discharge unit 7 within a main body 2 of the color laser printer 1. The feed unit 5 feeds one or more sheets 51 therefrom. A sheet 51 is an example of a recording sheet. The image forming unit 6 forms an image onto each of one or more fed sheets 51. The discharge unit 7 discharges one or more sheets 51 each having an image thereon to the outside of the main body 2.

The feed unit 5 is disposed in a lower portion of the main body 2. The feed unit 5 includes a feed tray 50 and a feed mechanism M1. The feed tray 50 is attachable to and detachable from the main body 2 from the front of the color laser printer 1 through a sliding operation. The feed mechanism M1 feeds one or more sheets 51 upward, one by one, from the feed tray 50, and conveys the fed sheet 51 toward the rear while turning the sheet 51 upside down.

The feed mechanism M1 includes a pickup roller 52, a separation roller 53, and a separation pad 54, which are disposed near a front end portion of the feed tray 50 and cooperate with each other to feed one or more sheets 51 upward, one by one, from the feed tray 50. The sheet 51 upwardly conveyed then passes between a dust removing roller 55 and a pinch roller 56. Thereafter, the sheet 51 is further conveyed toward the rear through a conveyance path 57 and is then supplied onto a conveyor belt 73. While a sheet 51 passes between the dust removing roller 55 and the pinch roller 56, paper dust adhering to the sheet 51 is removed from the sheet 51 by the dust removing roller 55.

The image forming unit 6 includes a scanner unit 61, a process unit 62, a transfer unit 63, and a fixing device 100.

The scanner unit 61 is disposed in an upper portion of the main body 2. The scanner unit 61 includes a laser emitting portion, a polygon mirror, lenses, and reflectors. In the scanner unit 61, the laser emitting portion emits laser beams corresponding to respective colors, for example, cyan, magenta, yellow, and black, and the polygon mirror scans the emitted laser beams in a right-left direction at high speed. After the laser beams pass or are reflected off the lenses and the reflectors, the laser beams are irradiated onto corresponding photosensitive drums 31 provided for the respective colors.

The process unit 62 is disposed below the scanner unit 61 and above the feed unit 5. The process unit 61 includes a photosensitive body unit 3 that is movable in a front-rear direction relative to the main body 2. The photosensitive body unit 3 includes drum sub units 30 and developing cartridges 40. The developing cartridges 40 are attached to the respective drum sub units 30. All of the drum sub units 30 have a similar or the same configuration and operate in a similar or the same manner. All of the developing cartridges 40 also have a similar or the same configuration and operate in a similar or the same manner. Therefore, a detailed description will be given on one of the drum sub units 30 and one of the developing cartridges 40.

The drum sub unit 30 includes a photosensitive drum 31 and a scorotron charger 32, both of which have a known configuration.

The developing cartridge 40 stores toner therein. Toner is an example of a developing agent. The developing cartridge 40 includes a supply roller 41, a developing roller 42, and a layer thickness regulating blade 43, all of which also have a known configuration.

In the process unit 62, the supply roller 41 supplies toner to a surface of the developing roller 42 in the developing cartridge 40 while toner is positively charged by friction caused between the supply roller 41 and the developing roller 42. Then, the layer thickness regulating blade 43 rubs over the surface of the developing roller 42 carrying toner supplied from the supply roller 41 in response to rotation of the developing roller 42. Thus, toner becomes a thin layer having a certain thickness and is held on the surface of the developing roller 42.

In the drum sub unit 30, the scorotron charger 32 charges a surface of the photosensitive drum 31 uniformly by corona discharge. A laser beam is emitted onto the charged surface of the photosensitive drum 31 from the scanner unit 61 to form an electrostatic latent image corresponding to an image to be formed on a sheet 51, onto the surface of the photosensitive drum 31.

As the photosensitive drum 31 rotates, the developing roller 42 supplies toner held on its surface onto a portion, of which potential is lowered due to exposure with a laser beam, of the surface of the photosensitive drum 31 charged positively and uniformly, that is, onto an electrostatic latent image formed on the surface of the photosensitive drum 31. Thus, the electrostatic latent image formed on the surface of the photosensitive drum 31 is visualized using toner of one of the colors. Therefore, the photosensitive drum 31 carries a toner image obtained through a reversal development on its surface.

The transfer unit 63 includes a drive roller 71, a driven roller 72, the conveyor belt 73, transfer rollers 74, and a cleaning unit 75.

The drive roller 71 and the driven roller 72 extend parallel to each other while being spaced apart from each other in the front-rear direction. The conveyor belt 73 is looped around the drive roller 71 and the driven roller 72. The conveyor belt 73 may be an endless belt. The conveyor belt 73 has an outer surface and an inner surface. The outer surface of the conveyor belt 73 is in contact with the surfaces of the photosensitive drums 31. The transfer rollers 74 are disposed inside the loop of the conveyor belt 73. Each of the transfer rollers 74 and a corresponding one of the photosensitive drums 31 pinch the conveyor belt 73 therebetween. A transfer bias is applied to the transfer rollers 74 from a high-voltage circuit board (not depicted). At the time of forming an image onto a sheet 51, the sheet 51 conveyed by the conveyor belt 73 is pinched between one or more of the photosensitive drums 31 and one or more corresponding ones of the transfer rollers 74 and one or more toner images are transferred onto the sheet 51 from the one or more of the photosensitive drums 31.

The cleaning unit 75 is disposed below the conveyor belt 73. A toner storage 76 is disposed below the cleaning unit 75. The cleaning unit 75 removes toner from the surface of the conveyor belt 73 and drops toner to the toner storage 76.

The fixing device 100 is disposed to the rear of the transfer unit 63. The fixing device 100 fixes, onto a sheet 51, one or more toner images transferred onto the sheet 51 by heat.

A discharge path 91 is defined in the discharge unit 7. The discharge path 91 extends upward from the exit of the fixing device 100 and curves toward the front. A plurality of conveyor rollers 92 for conveying a sheet 51 defines portions of the discharge path 91. The main body 2 includes a discharge tray 93. The top of the main body 2 functions as the discharge tray 93 for supporting one or more sheets 51 on which printing has been performed. One or more sheets 51 discharged by the conveyor rollers 92 through the discharge path 91 are supported by the discharge tray 93.

<Detailed Configuration of Fixing Device>

Figure 2:
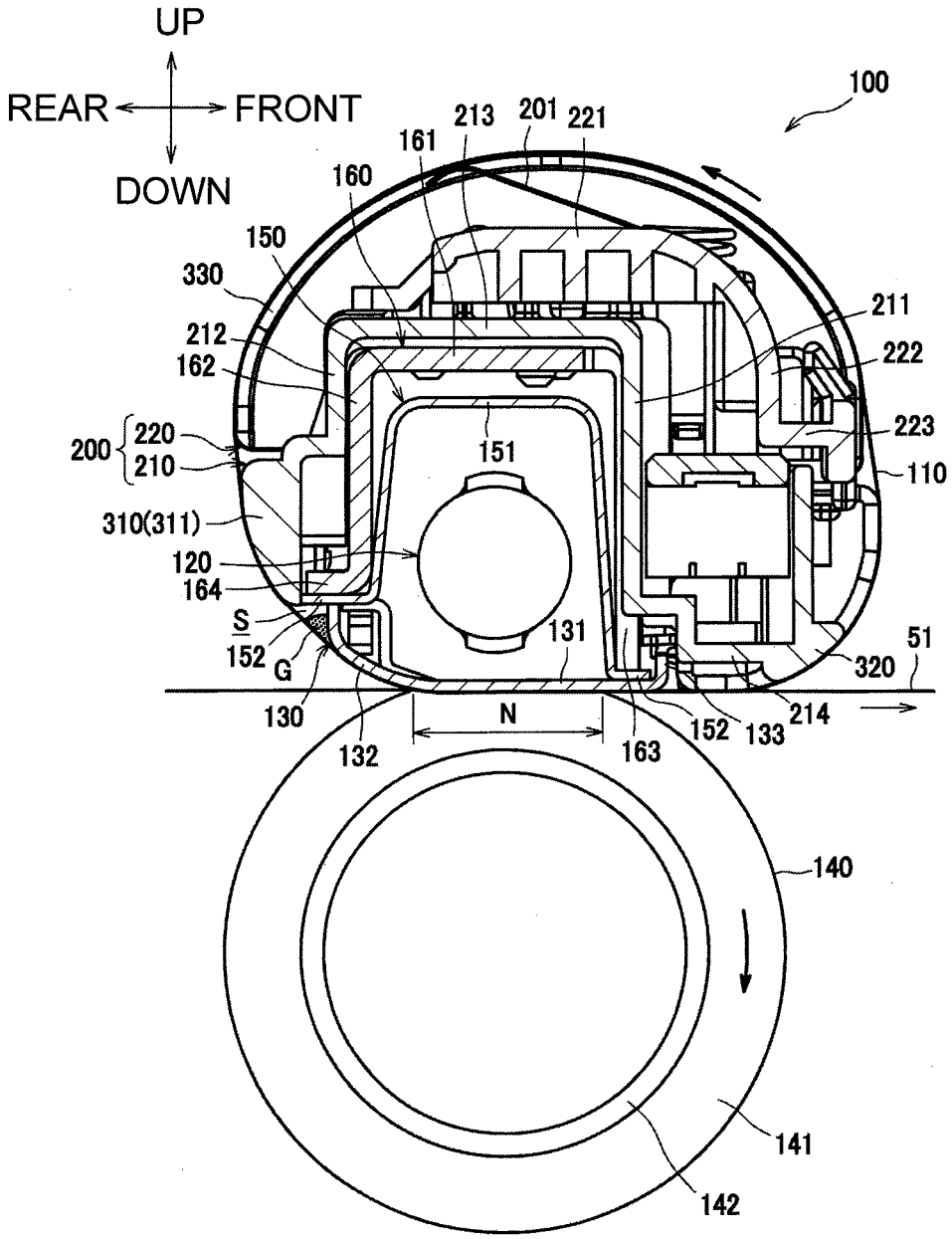
FIG. 2 is a sectional view depicting the fixing device in the illustrative embodiment according to one or more aspects of the disclosure.

As depicted in FIG. 2, the fixing device 100 includes a fixing belt 110, a halogen lamp 120 (e.g., a heater), a nip plate 130, a pressing roller 140, a reflecting plate 150, a stay 160, a cover member 200. The fixing belt 110 is an example of an endless belt. The nip plate 130 is an example of a nip member. The pressing roller 140 is an example of a backup member. The cover member 200 may be made of, for example, resin.

The fixing belt 110 may be an annular endless belt having heat resistance and flexibility. The cover member 200 includes a guide portion including an upstream guide 310, a downstream guide 320, and edge-portion guides 330. When the fixing belt 110 rotates, the guide portion guides the fixing belt 110. In the illustrative embodiment, the fixing belt 110 may be a metallic belt including a metal base material and a coat of resin applied to one surface (e.g., an outer surface) of the metal base material.

In other embodiments, for example, the fixing belt 110 may have a rubber layer on the outer surface of the metal base material. The fixing belt 110 may further have a nonmetal protective layer on a surface of the rubber layer with fluorine coating.

The cover member 200 includes a wire spring 201. The wire spring 201 applies a relatively weak urging force to a portion of the fixing belt 110. Thus, the fixing belt 110 is urged in a direction away from the center of the fixing belt 110 with respect to a diameter direction of the fixing belt 110. With this configuration, the fixing belt 110 is rotatable in a rotating direction under tension by the wire spring 201 (Therefore, the fixing belt 110 is movable in the diameter direction under tension by the wire spring 201).

In other embodiments, for example, a leaf spring may be used for applying tension to the fixing belt 110, instead of the wire spring 201. In still other embodiments, for example, the wire spring 201 might not necessarily be required, and therefore, the wire spring 201 may be omitted.

The halogen lamp 120 emits radiant heat for heating the nip plate 130 and the fixing belt 110 (e.g., the nip portion N) so as to heat toner held by a sheet 51. The halogen lamp 120 is disposed inside the loop of the fixing belt 110 while being spaced apart from the inner surface of the fixing belt 110 and an upper surface of the nip plate 130 by a predetermined gap.

The nip plate 130 is disposed inside the loop of the fixing belt 110. The nip plate 130 may be a plate-shaped member for receiving radiant heat emitted from the halogen lamp 120. The nip plate 130 has a lower surface (e.g., a contact surface) that is in contact with the inner surface of the fixing belt 110 such that the endless belt is slidable over the lower surface of the nip plate 130. In the illustrative embodiment, the nip plate 130 may be made of metal, for example, aluminum, which has a thermal conductivity larger than steel used for the stay 160. For example, a bent aluminum plate may be used for the nip late 130. The nip plate 130 made of aluminum may enable an increase of thermal conductivity of the nip plate 130.

Figure 3:
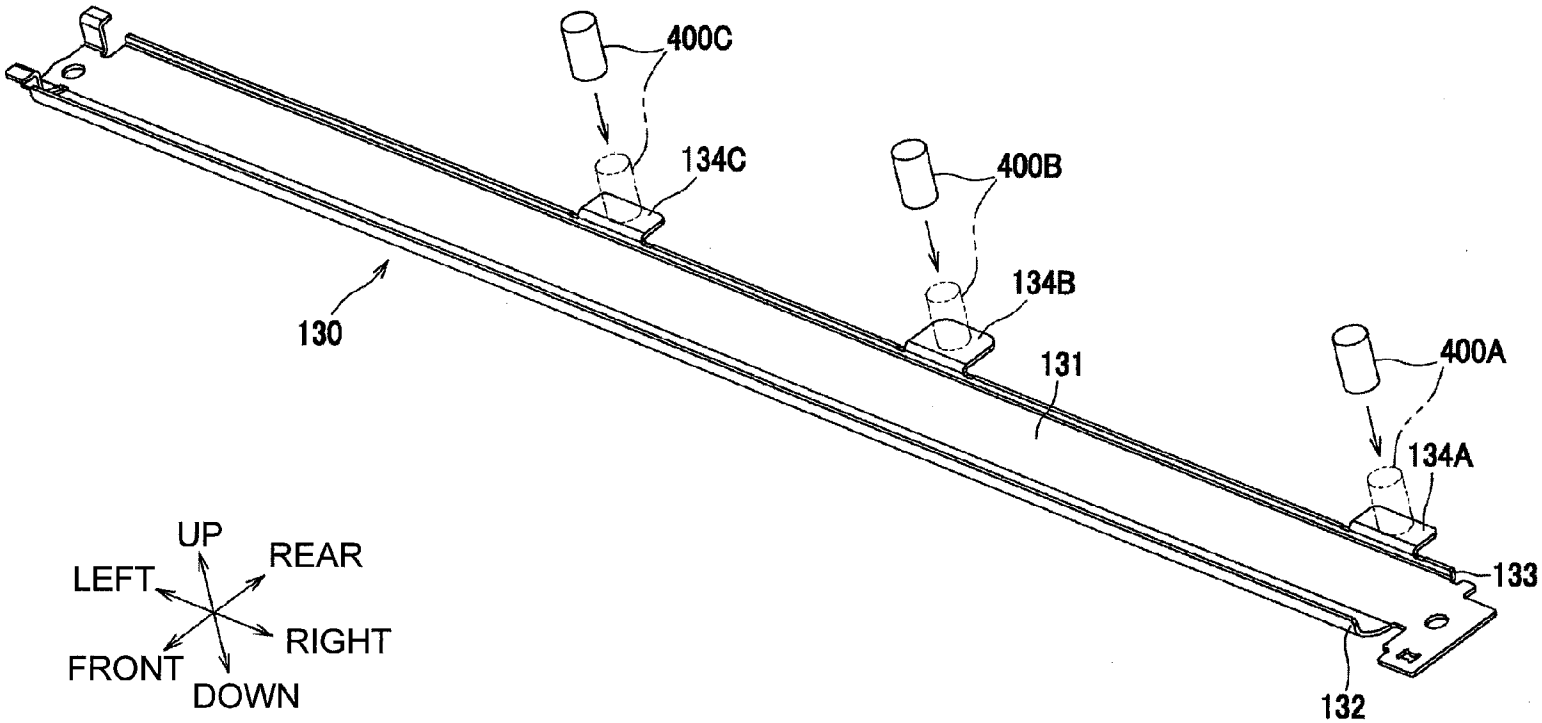
FIG. 3 is a perspective view depicting a nip plate in the illustrative embodiment according to one or more aspects of the disclosure.

As depicted in FIGS. 2 and 3, the nip plate 130 includes a plate-shaped portion 131, a front bent portion 132, a rear bent portion 133, and a plurality of, for example, three, detection target portions 134A, 134B, and 134C.

The plate-shaped portion 131 is elongated in the right-left direction while extending in a direction orthogonal to an up-down direction. The plate-shaped portion 131 may have black coating or include a heat absorbing member on its one surface (e.g., the upper surface), which may enable the plate-shaped portion 131 to absorb radiant heat emitted from the halogen lamp 120 effectively.

A front end portion of the plate-shaped portion 131 is bent upward to provide the front bent portion 132. The front bent portion 132 extends curvedly upward and has a generally arc shape in side view. More specifically, the front bent portion 132 extends toward a flange 164 of the stay 160 and an upper end of the front bent portion 132 is held by one (e.g., a front flange 152) of flanges 152 of the reflecting plate 150 and the flange 164 of the stay 160.

A rear end portion of the plate-shaped portion 131 is bent upward to provide the rear bent portion 133. The rear bent portion 133 extends upward.

Temperatures of the detection target portions 134A, 134B, and 134C are detected by a thermistor 400A, a thermistor 400B, and a thermostat 400C, respectively. The detection target portions 134A, 134B, and 134C extend rearward from respective portions of an upper end of the rear bent portion 133.

Referring to FIG. 2, the pressing roller 140 is disposed below the nip plate 130. The pressing roller 140 pinches the fixing belt 110 in conjunction with the nip plate 130 to form a nip portion N between the fixing belt 10 and the pressing roller 140. In the illustrative embodiment, one of the nip plate 130 and the pressing roller 140 is urged toward the other of the nip plate 130 and the pressing roller 140 to form the nip portion N. The pressing roller 140 rotates while the pressing roller 140 and the nip plate 130 pinch the fixing belt 110 therebetween. With this rotation of the pressing roller 140, the pressing roller 140 rotates along with the fixing belt 110 to convey a sheet 51 rearward.

The pressing roller 140 includes a cylindrical roller body 141 and a shaft 142. The shaft 142 passes through the roller body 141 and is rotatable integrally with the roller body 141. The roller body 141 may be elastically deformable. The pressing roller 140 rotates by transmission of driving force from a motor (not depicted) disposed within the main body 2. The rotation of the pressing roller 140 causes friction between the pressing roller 14 and one of the fixing belt 110 and a sheet 51 held by the fixing belt 110, which causes rotation of the fixing belt 110. While a sheet 51 having one or more toner images transferred thereon is conveyed between the pressing roller 140 and the heated fixing belt 110 (e.g., the nip portion N), the one or more toner images (e.g., toner) are fixed on the sheet 51 by heat.

The reflecting plate 150 reflects radiant heat emitted from the halogen lamp 120 toward the nip plate 130. The reflecting plate 150 is disposed inside the loop of the fixing belt 110 while surrounding the halogen lamp 120. The reflecting plate 150 is spaced apart from the halogen lamp 120 by a predetermined gap.

The reflecting plate 150 may be made of, for example, aluminum having large reflectivity of infrared rays and far-infrared rays. The reflecting plate 150 has a U shape in cross section. More specifically, the reflecting plate 150 includes a U-shaped reflecting portion 151 and the flanges 152. The front flange 152 extends toward the front from a front end (e.g., one of ends facing the nip plate 130) of the reflecting portion 151 in the front-rear direction and the rear flange 152 extends from a rear end (e.g., the other of ends facing the nip plate 130) of the reflecting portion 151 in the front-rear direction.

Each of the flanges 152 is pinched between the stay 160 and the nip plate 130.

The stay 160 receives a load from the pressing roller 140 while holding the nip plate 130 via the reflecting plate 150. The stay 160 is disposed inside the loop of the fixing belt 110 while surrounding the halogen lamp 120 and the reflecting plate 150. In a case where the nip plate 130 urges the pressing roller 140, the load that the stay 160 receives from the pressing roller 140 may be reaction force of urging force of the nip plate 130 that urges the pressing roller 140.

More specifically, the stay 160 includes an upper wall 161, a front wall 162, and a rear wall 163 and has a U shape in cross section. The front wall 162 extends downward from a front end of the upper wall 161. The rear wall 163 extends downward from a rear end of the upper wall 161. The stay 160 further includes the flange 164 extending frontward from a lower end of the front wall 162.

For example, a bent steel sheet having relatively higher stiffness may be used for the stay 160.

The cover member 200 includes a first cover member 210 and a second cover member 220, both of which are made of resin.

The first cover member 210 has a U shape in cross section and is elongated in the right-left direction. The first cover member 210 covers the stay 160 while facing the halogen lamp 120 across the stay 160. In other words, the first cover member 210 is disposed opposite to the nip plate 130 relative to the stay 160.

The first cover member 210 includes a rear wall 211, a front wall 212, an upper wall 213, and an extended wall 214. The upper wall 213 connects an upper end of the rear wall 211 and an upper end of the front wall 212 to each other. The extended wall 214 extends rearward from a lower end of the rear wall 211.

The first cover member 210 further includes an upstream guide 310 integrally with a lower end portion of the front wall 212. The upstream guide 310 guides a lower front portion of the fixing belt 110. The first cover member 210 further includes a downstream guide 320 integrally with a rear end portion of the extended wall 214. The downstream guide 320 guides a lower rear portion of the fixing belt 110.

Figure 4:
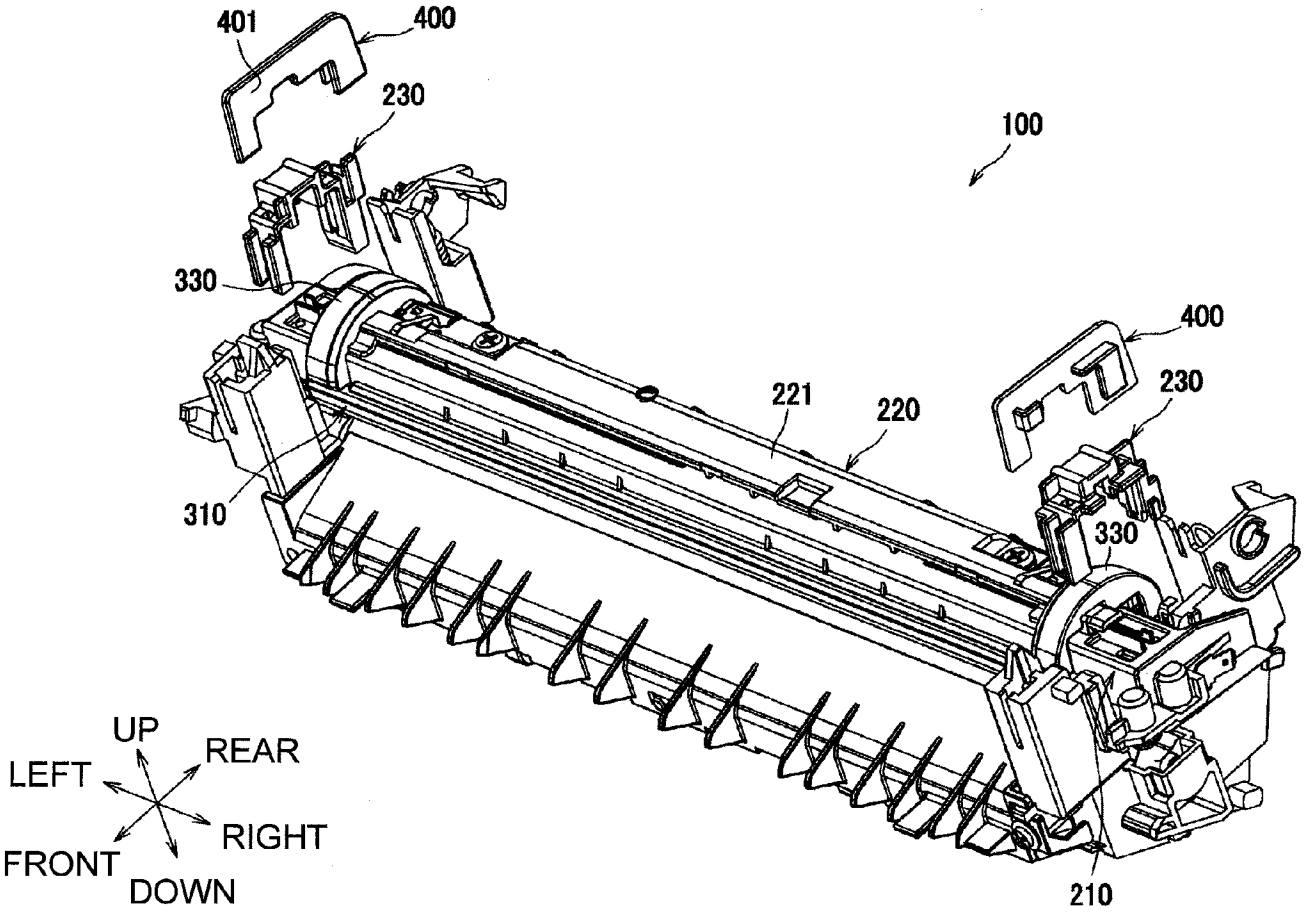
FIG. 4 is a disassembled perspective view depicting the fixing device including edge regulating members and an upstream guide in the illustrative embodiment according to one or more aspects of the disclosure.

The upstream guide 310 is disposed upstream of the nip portion N in the rotating direction of the fixing belt 110 and guides the fixing belt 110 toward the nip portion N. As depicted in FIG. 4, the upstream guide 310 is elongated in the right-left direction. A plurality of, for example, two, edge regulating members 400 are disposed above respective right and left end portions of the upstream guide 310 in the right-left direction. Each of the edge regulating members 400 has a regulating surface 401 for regulating a position of a corresponding one of the edges of the fixing belt 110.

A plurality of, for example, two, edge-portion guides 330 are disposed above and adjacent to respective right and left end portions of the upstream guide 310 in the right-left direction. The right edge-portion guide 330 is in contact with a right edge portion of the inner surface of the fixing belt 110 and the left edge-portion guides 330 is in contact with a left edge portion of the inner surface of the fixing belt 110. Under this state, the edge-portion guides 330 guide the fixing belt 110 to the upstream guide 310 while the fixing belt 100 slides over the edge-portion guides 330. The edge-portion guides 330 are disposed closer to the center of the fixing belt 110 in a width direction (e.g., the right-left direction) of the fixing belt 110 than the respective edge regulating members 400 in the right-left direction. The right and left edge regulating members 400 are disposed at the respective right and left end portions of the first cover member 210 in the right-left direction via respective intermediate members 230.

As depicted in FIGS. 2 and 4, the second cover member 220 is elongated in the right-left direction. The second cover member 220 is disposed above the first cover member 210 (e.g., is disposed opposite to the stay 160 relative to the first cover member 210) so as to cover a portion of the first cover member 210. The second cover member 220 includes an upper wall 221, a rear wall 222, and an extended wall 223. The rear wall 222 extends downward from a rear end of the upper wall 221. The extended wall 223 extends rearward from a lower end of the rear wall 222. As depicted in FIG. 4, the right and left edge-portion guides 330 for guiding an upper portion of the fixing belt 110 are disposed integrally with respective right and left end portions of the upper wall 221 of the second cover member 220 in the right-left direction.

<Detailed Configuration of Upstream Guide 310>

Figure 5A:
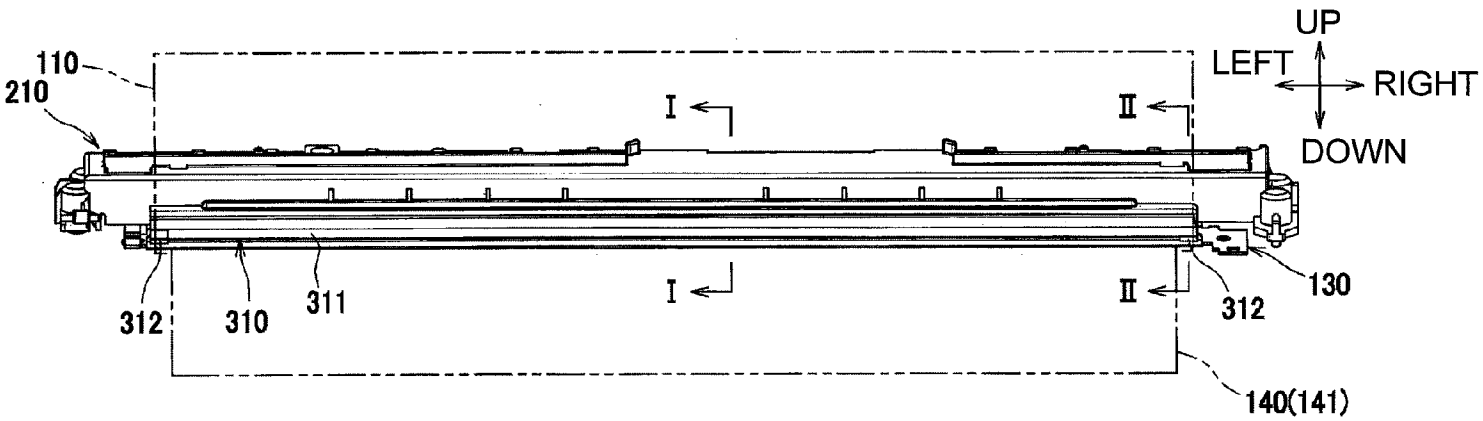
FIG. 5A is a front view depicting the upstream guide and the nip plate in the illustrative embodiment according to one or more aspects of the disclosure.
Figure 5B:
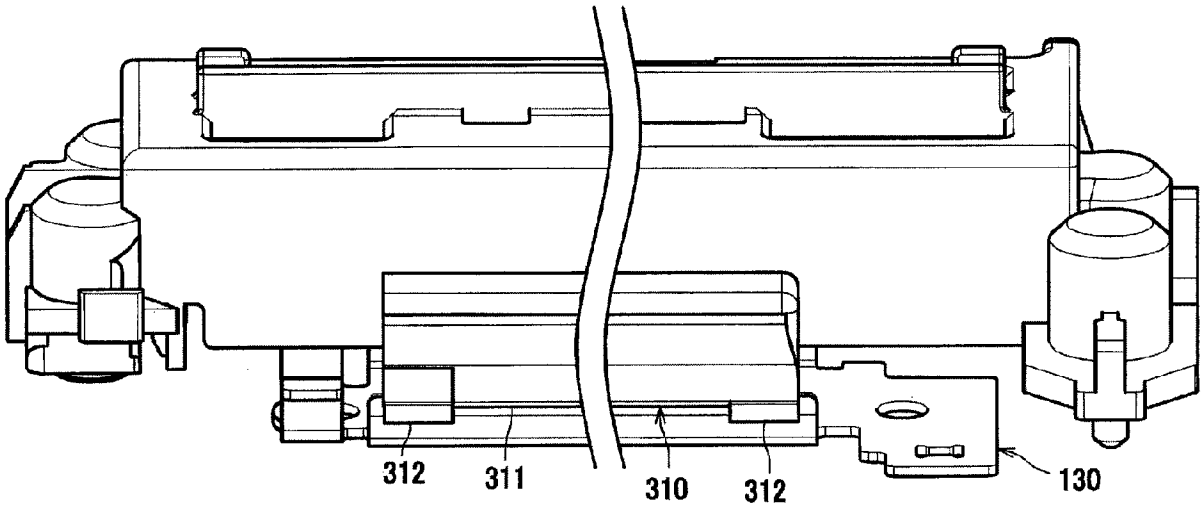
FIG. 5B is an enlarged view depicting end portions of the upstream guide in the illustrative embodiment according to one or more aspects of the disclosure.
Figure 6A:
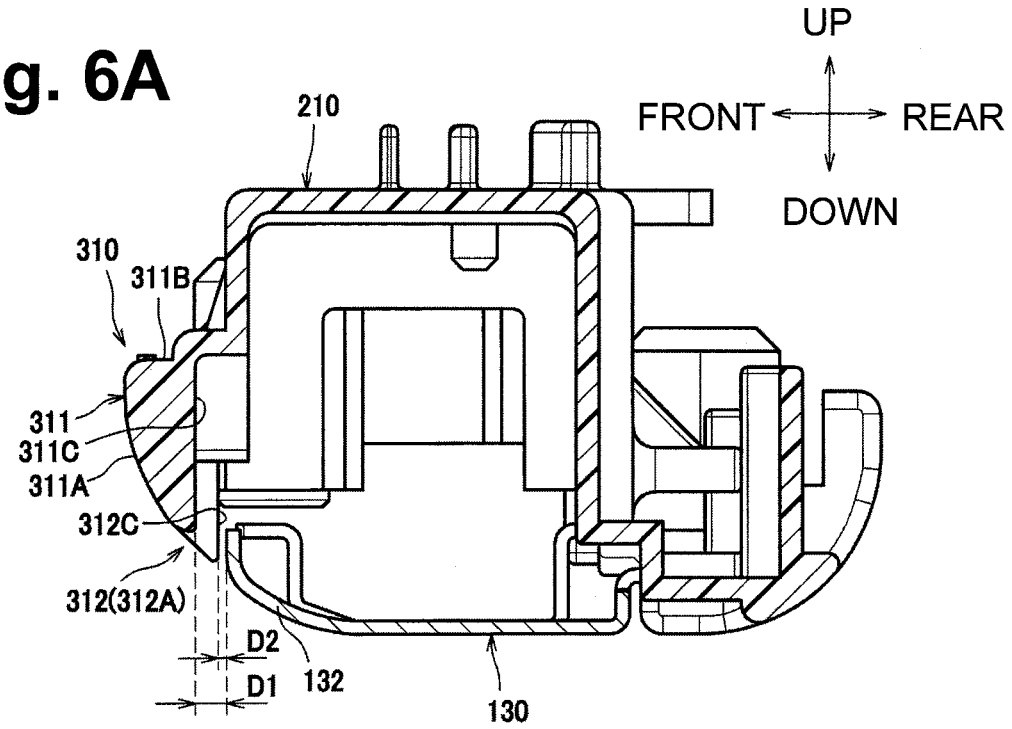
FIG. 6A is a sectional view taken along line I-I in FIG. 5A in the illustrative embodiment according to one or more aspects of the disclosure.
Figure 6B:
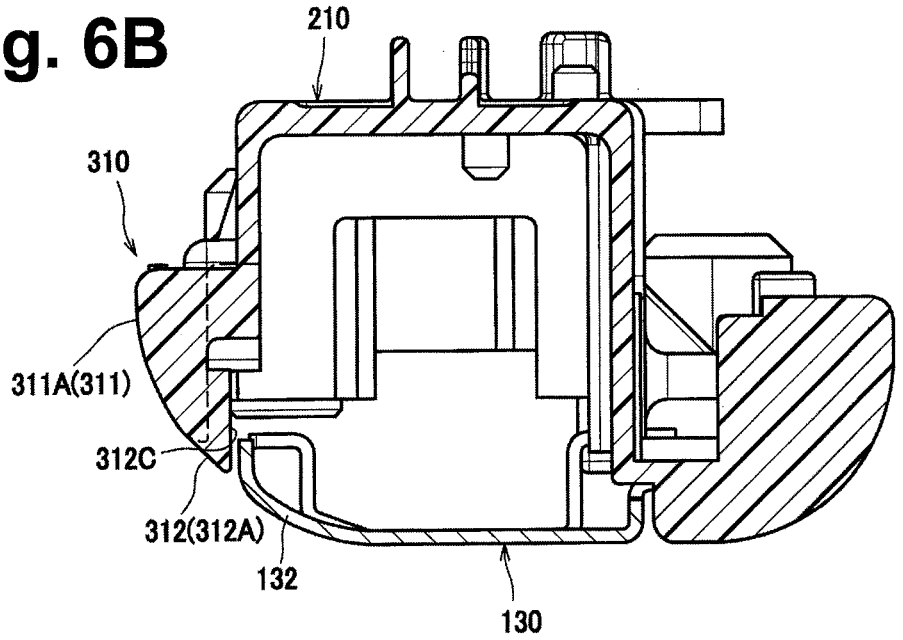
FIG. 6B is a sectional view taken along line II-II in FIG. 5A in the illustrative embodiment according to one or more aspects of the disclosure.

Referring to FIGS. 5A, 5B, 6A, and 6B, the upstream guide 310 will be described in detail. In FIGS. 5A and 5B, for convenience in drawing, the upstream guide 310 and the nip plate 130 are indicated by solid lines and the fixing belt 110 and the pressing roller 140 are indicated by double-dotted and dashed lines. In FIGS. 6A and 6B, for convenience in drawing, only the upstream guide 310 and the nip plate 130 are illustrated.

As depicted in FIG. 5A, the right and left edges of the fixing belt 110, the right and left ends of the nip plate 130, and the right and left ends of the upstream guide 310 protrude beyond the right and left ends, respectively, of the pressing roller 140 (more specifically, the right and left ends of the roller body 141) in the right-left direction (e.g., in the width direction of the fixing belt 110). Therefore, the protruding edge portions of the fixing belt 110 positioning in respective areas farther from the center of the fixing belt 110 in the width direction of the fixing belt 110 than the respective ends of the pressing roller 140, are not pinched between the nip plate 130 and the pressing roller 140. Thus, the protruding edge portions of the fixing belt 110 are capable of free movement.

As depicted in FIGS. 5A and 5B, the upstream guide 310 includes a base portion 311 and a plurality of, for example, two, regulating portions 312. The base portion 311 is elongated in the right-left direction. The regulating portions 312 are integral with the base portion 311. For example, in the illustrative embodiment, the regulating portions 312 and the upstream guide may consist of one piece. The regulating portions 312 extend from respective end portions in the right-left direction of the base portion 311 and protrude downward relative to the base portion 311. An entire portion of the right regulating portion 312 is disposed at a position farther from the center of the fixing belt 110 in the with direction of the fixing belt 110 than the right end of the pressing roller 140 in the right-left direction, and also an entire portion of the left regulating portion 312 is disposed at a position farther from the center of the fixing belt 110 in the with direction of the fixing belt 110 than the left end of the pressing roller 140 in the right-left direction.

As depicted in FIG. 6A, the base portion 311 has a generally triangular shape in cross section. The base portion 311 has a guide surface 311A, an upper surface 311B, and a rear surface 311C. The guide surface 311A has an arc shape in cross section. The guide surface 311A faces the fixing belt 110 and guides the fixing belt 110. The upper surface 311B extends rearward from an upper end of the guide surface 311A. The rear surface 311C extends upward from a lower end of the guide surface 311A. A corner formed by the guide surface 311A and the upper surface 311B and a corner formed by the guide surface 311A and the rear surface 311C are chamfered to have an arc shape in cross section.

The base portion 311 is spaced apart from the nip plate 130 by a first gap D1 in the front-rear direction (e.g., in a sheet conveying direction). More specifically, a middle portion of the upstream guide 310 in the right-left direction is spaced apart from a middle portion of the nip plate 130 in the right-left direction by the first gap D1 in the front-rear direction.

As depicted in FIG. 2, the base portion 311 protrudes downward beyond the front flange 152 of the reflecting plate 150. With this configuration, the base portion 311 may keep the fixing belt 110 from getting caught in the front flange 152 of the reflecting plate 150.

A lubricant G is applied to a space between the base portion 311 and the front bent portion 132 of the nip plate 130. More specifically, the lubricant G is applied to a generally triangular space S defined by the base portion 311 of the upstream guide 310, the front flange 152 of the reflecting plate 150, the front bent portion 132 of the nip plate 130, and the fixing belt 110. By doing so, the lubricant G may be kept in a particular portion upstream of the nip portion N in the rotating direction of the fixing belt 110. Therefore, the lubricant G may enable the fixing belt 110 to rotate smoothly.

Referring to FIGS. 6A and 6B, the regulating portions 312 will be described. Since both the regulating portions 312 have a similar or the same configuration, one of the regulating portions 312 will be described in detail. The regulating portion 312 protrudes downward and rearward beyond the base portion 311 in both of the directions. In other words, at least a portion of the regulating portion 312 is positioned in an area including a gap (e.g., the first gap D1) between the base portion 311 (e.g., a middle portion) of the upstream guide 310 and a middle portion of the nip plate 130 in the width direction of the fixing belt 110. The regulating portion 312 and the nip plate 130 are spaced apart from each other in the front-rear direction by a second gap D2 that is narrower than the first gap D1. In FIG. 6B, the second gap D2 between the base portion 311 and the regulating portion 312 is indicated by a dashed line. In other embodiments, for example, the second gap D2 might not necessarily be provided therebetween, that is, the regulating portion 312 and the nip plate 130 may be in contact with each other.

The protruding edge portions of the fixing belt 110 in the width direction of the fixing belt 110 to which pressing force of the pressing roller 40 is not applied are capable of free movement. According to the above-described configuration, the regulating portion 312 may keep a corresponding one of such edge portions of the fixing belt 110 in the width direction of the fixing belt 110 from getting caught in the gap between the upstream guide 310 and the nip plate 130, thereby preventing or reducing an occurrence of bending of the corresponding one of the protruding edge portions of the fixing belt 110. More specifically, the regulating portion 312 may prevent or reduce an occurrence of bending of the corresponding one of the protruding edge portions of the fixing belt 110 toward the center of the fixing belt 110 in the diameter direction of the fixing belt 110 due to contact with the corresponding edge regulating member 400.

The regulating portion 312 includes a guide surface 312A and a rear surface 312C. The guide surface 312A has an arc shape in cross section. The guide surface 312A faces the fixing belt 110 and guides the fixing belt 110. The rear surface 312C extends upward from a lower end of the guide surface 312A. The guide surface 312A extends obliquely downward toward the rear beyond the lower end of the guide surface 311A of the base portion 311 while extending toward the nip plate 130. With this configuration, an interval between the nip plate 130 and the guide surface 312A of the regulating portion 312 in the front-rear direction is narrower than an interval between the nip plate 130 and the guide surface 311A of the base portion 311 in the front-rear direction.

The guide surface 312A of the regulating portion 312 is flush with the guide surface 311A of the base portion 311. This configuration may enable the guide surface 312A of the regulating portion 312 and the guide surface 311A of the base portion 311 to guide the fixing belt 110 smoothly, thereby ensuring stable rotation of the fixing belt 110.

As described above, the front bent portion 132 has a generally arc shape in side view. The guide surface 312A of the regulating portion 312 extends approximately along a tangent to a lower surface of the arc-shaped front bent portion 132 of the nip plate 130. This configuration may enable the guide surface 312A of the regulating portion 312 to guide the fixing belt 110 to the nip plate 130 smoothly.

A corner formed by the guide surface 312A and the rear surface 312C is chamfered to have an arc shape in cross section. The right regulating portion 312 is disposed to the right of the space S so as to close the space S (refer to FIG. 2) from the right in the right-left direction and the left regulating portion 312 is disposed to the left of the space S so as to close the space S (refer to FIG. 2) from the left in the right-left direction. That is, the regulating portion 312 is disposed at a position farther from the center of the fixing belt 110 in the width direction of the fixing belt 110 than a corresponding one of the right and left ends of the front flange 152 of the reflecting plate 150 on the same side in the right-left direction and protrudes downward beyond the front flange 152. This configuration may prevent or reduce movement of the lubricant G applied to the space S in a direction that is away from the center of the fixing belt 110 with respect to the right-left direction. Therefore, the lubricant G may remain in the particular place (e.g., in the space S) upstream of the nip portion N in the rotating direction of the fixing belt 110 appropriately.

According to the illustrative embodiment, effects described below may also be obtained in addition to the above-described effects.

As depicted in FIG. 5A, the entire portions of the regulating portions 312 are located at the respective positions farther from the center of the fixing belt 110 in the with direction of the fixing belt 110 than the respective right and left ends of the pressing roller 140 in the right-left direction, that is, the entire portions of the regulating portions 312 are located at the respective positions corresponding to the protruding edge portions of the fixing belt 110 to which pressing force is not applied by the pressing roller 140. This configuration may avoid or reduce needless absorption of heat from the nip portion N by the regulating portions 312.

The regulating portions 312 and the upstream guide 310 may consist of one piece made of resin. Therefore, the regulating portions 312 may be provided to the upstream guide 310 easily.

While the disclosure has been described in detail with reference to the example drawings, it is not limited to such examples. Various changes, arrangements, and modifications may be realized without departing from the spirit and scope of the disclosure. In the description below, common parts have the same reference numerals as those of the above-described embodiments, and the detailed description of the common parts is omitted.

Figure 7A:
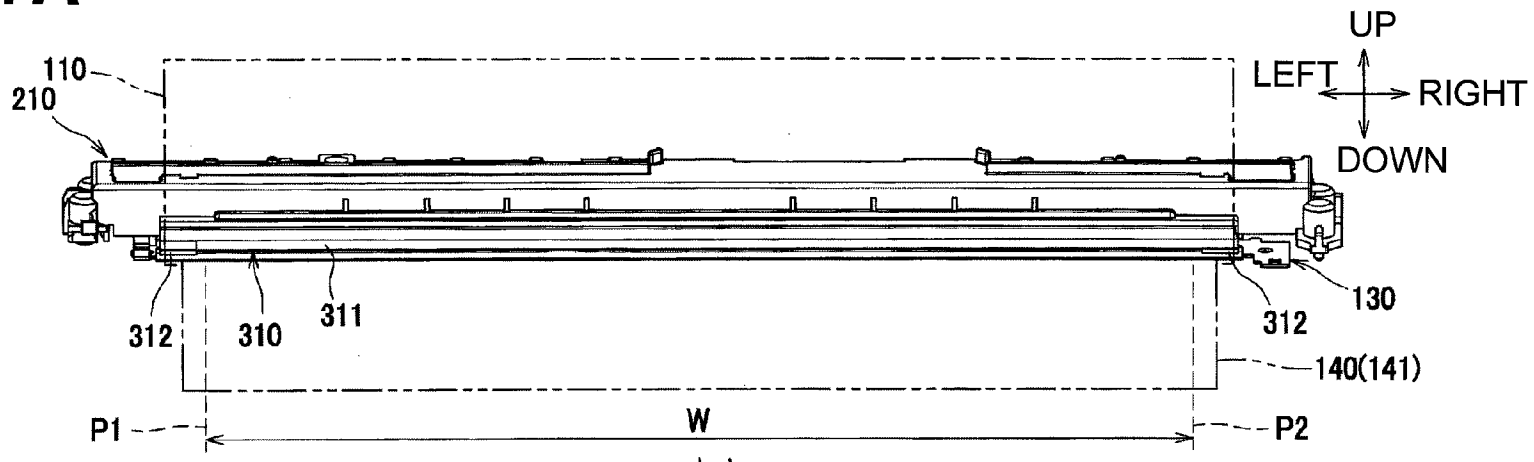
FIG. 7A is a front view depicting an upstream guide in a first variation of the illustrative embodiment according to one or more aspects of the disclosure.
Figure 7B:
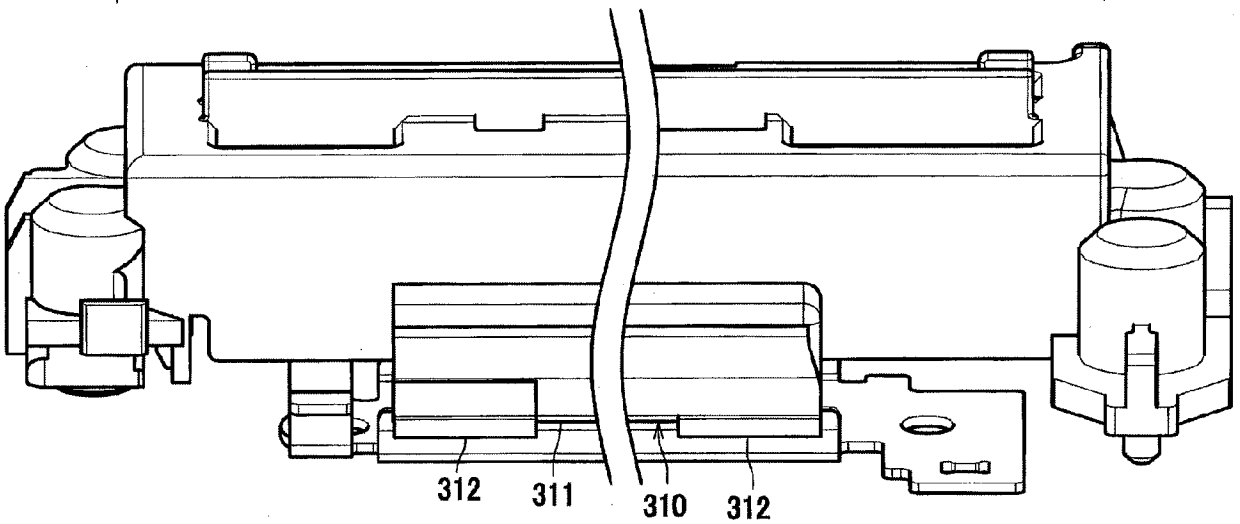
FIG. 7B is an enlarged view depicting end portions of the upstream guide in the first variation of the illustrative embodiment according to one or more aspects of the disclosure.

In the illustrative embodiment, the entire portions of the regulating portions 312 are located at the respective positions farther from the center of the fixing belt 110 in the with direction of the fixing belt 110 than the respective right and left ends of the pressing roller 140 in the right-left direction. Nevertheless, in other embodiments, for example, as depicted in FIGS. 7A and 7B, the regulating portions 312 may be disposed at respective positions such that the right regulating portion o312 extends between a position farther from the center of the fixing belt 110 than the right end of the pressing roller 140 in the width direction of the fixing belt 110 and a position closer to the center of the endless belt than the right end of the pressing roller 140 in the width direction of the fixing belt 110 and the left regulating portion o312 extends between a position farther from the center of the fixing belt 110 than the left end of the pressing roller 140 in the width direction of the fixing belt 110 and a position closer to the center of the endless belt than the left end of the pressing roller 140 in the width direction of the fixing belt 110. Nevertheless, in this case, the entire portions of the regulating portions 312 may be disposed at respective positions father from the center of the fixing belt 110 in the width direction of the fixing belt 110 than respective corresponding side edges of a sheet 51 having a maximum available width on which the fixing device 100 is available to perform fixing. In other words, the left regulating portions 312 may be disposed at a position father from the center of the fixing belt 110 in the width direction of the fixing belt 110 than a first plane P1 that extends orthogonal to the right-left direction and corresponds to the left edge of the sheet 51 having a maximum available width, and the right regulating portions 312 may be disposed at a position father from the center of the fixing belt 110 in the width direction of the fixing belt 110 than a second plane P2 that extends orthogonal to the right-left direction and corresponds to the right edge of the sheet 51 having a maximum available width.

Therefore, this configuration may avoid or reduce absorption of heat from a portion of the fixing belt 110 that corresponds to the width of a sheet 51 having a maximum available width by the regulating portions 312. Accordingly, this configuration may enable the fixing belt 100 to fix toner onto a sheet 51 having a maximum available width appropriately.

Figure 8:
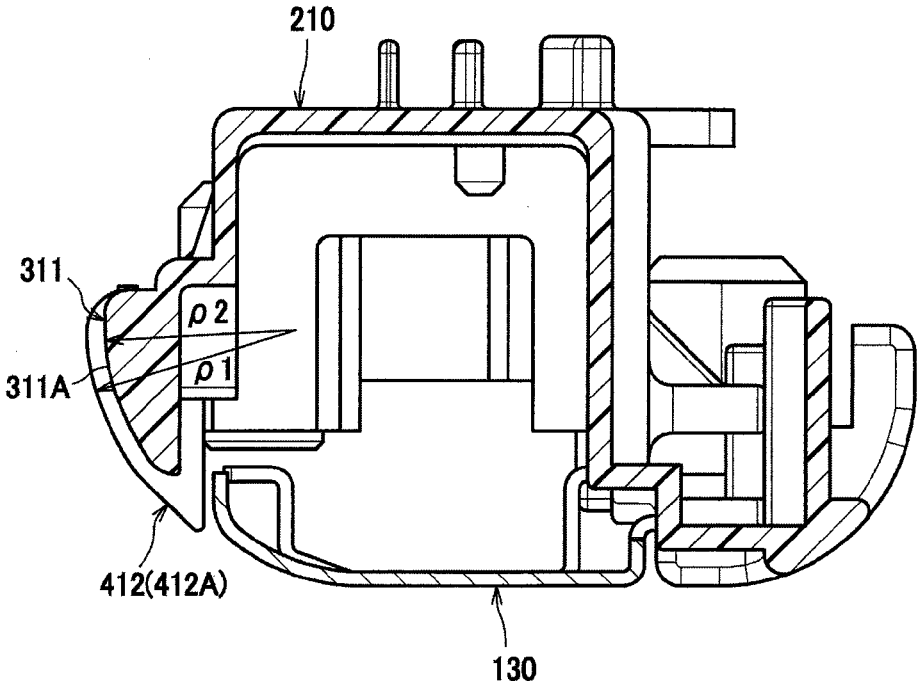
FIG. 8 is a sectional view depicting a regulating portion in a second variation of the illustrative embodiment according to one or more aspects of the disclosure.

In the illustrative embodiment, the guide surface 312A of the regulating portion 312 is flush with the guide surface 311A of the base portion 311. Nevertheless, in other embodiments, for example, as depicted in FIG. 8, a regulating portion 412 having a guide surface 412A may be provided instead of the regulating portion 312. The regulating portion 412 may protrude toward the fixing belt 110 further than the guide surface 311A of the base portion 311 such that the guide surface 412A of the regulating portion 412 may be disposed at a position father from the center of the fixing belt 110 in the diameter direction of the fixing belt 110 than the guide surface 311A of the base portion 311.

In this case, a curvature radius ρ1 of the guide surface 412A of the regulating portion 412 may be greater than a curvature radius ρ2 of the guide surface 311A of the base portion 311. With this configuration, a curvature radius of an edge portion of the fixing belt 110 supported by the guide surface 412A of the regulating portion 412 may be made larger. Therefore, this configuration may restrict or reduce local application of stress to the edge portion of the fixing belt 110 by the regulating portion 412.

In the illustrative embodiment, the upstream guide 310 includes the regulating portions 312. Nevertheless, in other embodiments, for example, the nip member may include such a regulating portion. In this case, a second gap may be provided between the regulating portion and the upstream guide in the conveying direction. The second gap may be narrower than a first gap provided between the upstream guide and the nip member. The regulating portion may be a separate part from the upstream guide or the nip member, and may be integral with one of the upstream guide and the nip member.

In the illustrative embodiment, a sheet 51, for example, thick paper, a post card, thin paper, is used as an example of the recording sheet. Nevertheless, in other embodiments, for example, the recording sheet may be, for example, an overhead projector sheet.

In the illustrative embodiment, the pressing roller 140 is used as an example of the backup member. Nevertheless, in other embodiments, for example, the backup member may be a belt-shaped pressing member.

In the illustrative embodiment, the nip plate 130 is used as an example of the nip member. Nevertheless, in other embodiments, for example, the nip member may be a thick member, for example, a block-like member.

In the illustrative embodiment, the disclosure has been applied to the color laser printer 1. Nevertheless, in other embodiments, for example, the disclosure may be applied to any image forming apparatus, for example, a copying device or a multifunction device.

In other embodiments, for example, the fixing belt 110 may include a resin film that may be predominantly composed of polyimide. In this case, the fixing belt 110 may has a coat of fluoro resin, e.g., polytetrafluoroethylene ("PTFE"), on its one surface.

What is claimed is:

1. A fixing device configured to fix a developing agent image onto a recording sheet by heat, comprising:

an endless belt having an inner surface and configured to rotate in a rotating direction;

a nip member having a contact surface that is in contact with the inner surface of the endless belt such that the endless belt is slidable over the contact surface of the nip member;

a backup member configured to:

pinch the endless belt in conjunction with the nip member to form a nip portion therebetween; and an upstream guide disposed upstream of the nip portion in the rotating direction and configured to guide the endless belt toward the nip portion; and a regulating portion disposed at one of the upstream guide and at least a portion of the nip member, at least a portion of the regulating portion disposed at a position farther from the center of the endless belt in a width direction of the endless belt than an end of the backup member in the width direction of the endless belt, wherein an end of the endless belt, an end of the nip member, and an end of the upstream guide disposed on the same side in the width direction of the endless belt protrude beyond the end of the backup member disposed on the same side in the width direction of the endless belt, wherein the upstream guide and the nip member are disposed with a first gap provided therebetween, in a conveying direction of the recording sheet, between a middle portion of the upstream guide in the width direction and a middle portion of the nip member in the width direction, and wherein the regulating portion and one of the upstream guide and the nip member are disposed with a second gap provided therebetween in the conveying direction of the recording sheet, wherein the second gap is smaller than the first gap in the conveying direction of the recording sheet.

2. The fixing device according to claim 1, wherein the regulating portion extends between a position farther from the center of the endless belt than the end of the backup member in the width direction of the endless belt and a position closer to the center of the endless belt than the end of the backup member in the width direction of the endless belt, and wherein an entire portion of the regulating portion is disposed at a position farther from the center of the endless belt in the width direction of the endless belt than a position corresponding to one of side edges of the recording sheet having a maximum available width on which the fixing device is configured to perform fixing.

3. The fixing device according to claim 1, wherein an entire portion of the regulating portion is disposed at a position farther from the center of the endless belt in the width direction of the endless belt than the end of the backup member in the width direction of the endless belt.

4. The fixing device according to claim 1, wherein the regulating portion and the upstream guide consist of one piece.

5. The fixing device according to claim 4, wherein a surface, facing the endless belt, of the regulating portion is flush with a surface, facing the endless belt, of the middle portion of the upstream guide.

6. The fixing device according to claim 4, wherein a surface, facing the endless belt, of the regulating portion protrudes toward the endless belt beyond the surface, facing the endless belt, of the middle portion of the upstream guide, and wherein a curvature radius of the surface of the regulating portion is greater than a curvature radius of the surface of the middle portion of the upstream guide.

7. The fixing device according to claim 1, wherein a lubricant is applied to a space between the upstream guide and the nip member in the rotating direction.

8. The fixing device according to claim 1, wherein at least a portion of the regulating portion is positioned in an area including the first gap provided between the middle portion of the upstream guide and the middle portion of the nip member in the width direction.

* * * * *